United States Patent [19]

Lillios

[11] Patent Number: 4,662,278

[45] Date of Patent: May 5, 1987

[54] FUSE ASSEMBLY

[76] Inventor: William N. Lillios, 1723 Church St. NE., Cleveland, Tenn. 37311

[21] Appl. No.: 712,676

[22] Filed: Mar. 18, 1985

[51] Int. Cl.[4] ..... F42B 25/02; F42C 15/22

[52] U.S. Cl. ..... 102/223; 102/244; 102/254; 102/487

[58] Field of Search ..... 102/223–227, 102/237, 244, 245, 254, 258, 260, 337, 339, 348, 354, 386, 387, 487, 489

[56] References Cited

U.S. PATENT DOCUMENTS 1,326,266 12/1919 Hope ..... 102/227

3,382,803 5/1968 Swallow et al. ..... 102/387

3,926,122 12/1975 Walterman ..... 102/226

3,956,992 5/1976 Tari ..... 102/244

4,488,488 12/1984 Looger et al. ..... 102/387

*Primary Examiner*—Harold J. Tudor

*Attorney, Agent, or Firm*—Robert T. Gammons

[57] ABSTRACT

A fuse assembly embodying a detonator movable by centrifugal force into alignment with a firing pin held retracted by a drogue and drag line and movable forwardly into engagement with the detonator by impact, the fuse assembly being attached to a grenade which, in turn, is attached to a projectile, for firing the grenade upon impact of the projectile with a target.

11 Claims, 10 Drawing Figures

FUSE ASSEMBLY

BACKGROUND OF THE INVENTION

A primary consideration in the design of fuses for military purposes is to provide for maximum safety of personnel involved independently of the technical experience of the personnel handling the equipment. It is, accordingly, an object of this invention to provide a fuse assembly comprising a fuse and grenade attached thereto structured to provide for maximum security prior to deployment and which does not become armed even though the firing pin is completely unscrewed, in contrast to the M223 fuse wherein unscrewing of the firing pin causes arming. Specifically, the fuse of this invention has three safety mechanisms in addition to the safety pin and, unlike the M223, does not embody a spring which, after unscrewing of the striker pin, can push the slider to an armed position, but, on the contrary, embodies a plastic safety mechanism which keeps it in locked position, thus complying with the requirements of Stanag 4157. The M223 has but two safety mechanisms, whereas that of the instant invention has three safety mechanisms independently of the safety pin.

SUMMARY OF THE INVENTION

As herein illustrated, the fuse assembly comprises a firing pin, a detonator housed in a movable slider that brings the detonator into a position of alignment with the firing pin by centrifugal force generated by rotation of the assembly (grenade and fuse attached) after the expulsion from the projectile above the target area, a drogue and drag ribbon attaching the drogue to the pin such as to withhold the firing pin during the free fall of the assembly (fuse and grenade) after the expulsion from the projectile. The firing pin is weighted so that, upon impact, it will be driven into percussive engagement with the detonator.

More specifically, the assembly comprises a cylindrical support containing an axial opening from end-to-end and a diametral slot at one end, a slider bar slidably mounted in the slot and movable diametrally therein containing a first opening centered in axial alignment with the opening in the support and a second opening radially thereof. The firing pin is mounted in the support with one end engaged within said first opening in the slider bar for rotation relative to the support to withdraw the firing pin from said first opening. The detonator is positioned in the second opening and the slider bar is movable diametrically when released to align the detonator with the firing pin. There is means attached to the opposite end of the firing pin operable to withhold the firing pin comprising a drogue and a drag ribbon connecting the drogue to the firing pin and means mounted to the firing pin operable by impact of the assembly to drive the firing pin into engagement with the detonator. There is latch means yieldably holding the slider bar against diametral movement, yieldable at a predetermined rate of rotation to release the bar. The drogue is a generally conical cap positioned astride the opposite end of the housing and the drag ribbon is a flexible tether ribbon threaded to the drogue and attached at its ends to the firing pin. There is a safety pin mounted to the housing provided with an end which overlies the drogue so as to retain the latter in engagement with the opposite end of the housing and an end constraining movement of the slider bar and also to prevent the unfolding of the ribbon. This pin is removed before loading the grenade assembly into the projectile. Desirably, the housing, slider bar, and drogue are comprised of a plastic, for example, polycarbonate. The textiled tether ribbon is made of polyester or nylon or silk.

The invention will now be described with reference to the accompanying drawings wherein.

Figure 1:
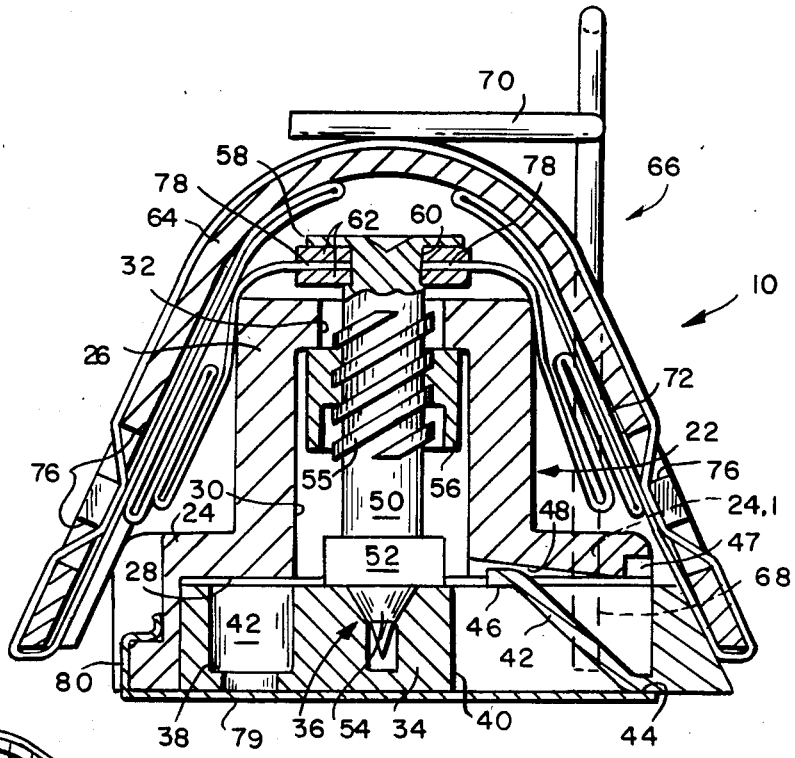
FIG. 1 is a vertical diametral section of the fuse with parts shown in elevation.
Figure 2:
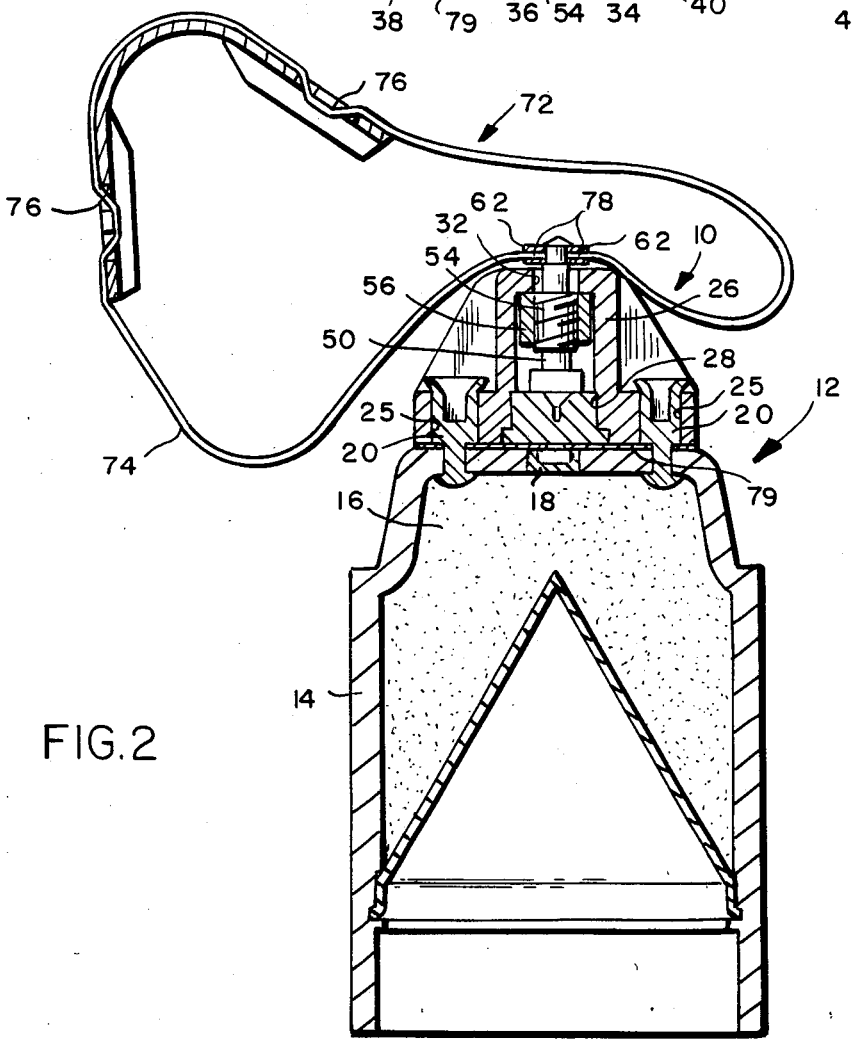
FIG. 2 is a fragmentary elevation showing the grenade to which the fuse is attached with the drogue and drag ribbon released.

Referring to FIGS. 1 and 2, there is shown a fuse assembly comprising a fuse 10 and grenade 12 attached thereto for mounting in a projectile for flight therewith and, at a predetermined altitude above a designated target, to be ejected from the projectile and dispersed. The rotation of the projectile about its longitudinal axis in flight causes the assembly comprising the fuse and grenade to rotate about its longitudinal axis. One or more assemblies are mounted in tandem in the projectile and, when ejected, are dispersed by rotation of the projectile.

The grenade 12, FIG. 2, is in the form of a sleeve 14 containing a charge 16 and the fuse 10, FIG. 1, is attached by means of attaching rivets 20—20 to the grenade over a lead cup 18 in communication with the charge.

Figure 4:
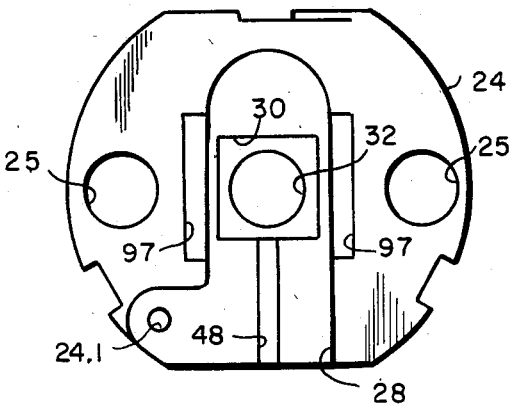
FIG. 4 is a bottom view of FIG. 3.
Figure 3:
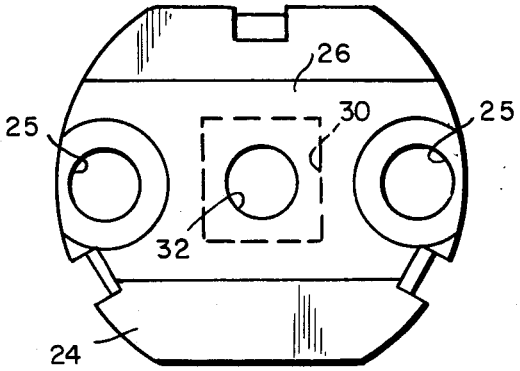
FIG. 3 is a plan view taken on the line 3—3 of FIG. 1.
Figure 5:
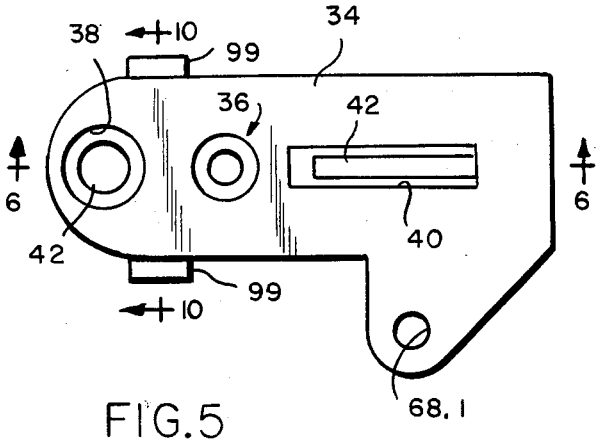
FIG. 5 is a plan view of the slider bar.
Figure 6:
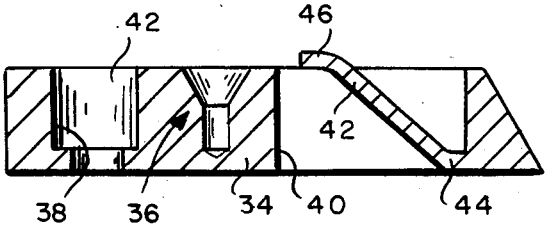
FIG. 6 is a diametral section of the slider bar on the line 6—6 of FIG. 5.
Figure 10:
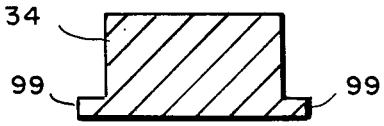
FIG. 10 is a cross section on the line 10—10 of FIGS. 5 and 7.

The fuse 10 comprises a fuse body 22, FIGS. 1, 3 and 4, embodying a base part 24 of generally circular cross section containing diametrically-spaced openings 25—25 for receiving the attaching rivets 20—20 by means of which it is secured to the grenade and a generally rectangular upper part 26 of smaller cross section. There is a diametral slot 28 in the base part which extends partway through from one side to the other, an opening 30 of rectangular cross section extending from the slot through the upper part from the lower end to near the upper end and an opening 32 at the top. A slider, FIG. 5, in the form of a bar 34 corresponding in cross section to the slot 28 is disposed in the slot and contains a center opening 36 partway through from the upper side and diametrally-positioned, radially-spaced openings 38 and 40. The opening 38 at one side is for receiving a detonator 42 and the opening 40 at the other side for containing a resilient latch 42, FIG. 6, the lower end 44 of which is fixed to the slider bar and the upper end 46 of which occupies an inclined groove 48, FIG. 1, formed in the base part 24.

A firing pin 50, FIGS. 1 and 2, is mounted in the upper part 26 within the openings 30 and 32 and has at its lower end a head 52 for engagement with the upper side of the slider bar 34 and a penetrating striker 54 which occupies the opening 36. At the upper end of the firing pin, there is a thread 55 threaded into a sleeve 56 of rectangular cross section which fits non-rotatably in the opening 30. The sleeve 56 comprises a weight. The firing pin 50 is rotatable within the sleeve 56 to retract the striker 54 from the opening 36 in the slider bar. At the upper end of the firing pin 50, there is an annular groove 60. A pair of washers 62—62 mounted in the groove provide for securing the ends 78—78 of a drag ribbon 72 therebetween for a purpose which will appear hereinafter.

A plastic cover 64, FIG. 1, comprising a drogue of generally conical configuration is mounted astride the fuse body 22 comprising the lower and upper parts 24 and 26 so as to cover the exposed end of the slider bar 34 to prevent its displacement and also to hold the ribbon 72 folded. The plastic cover 64 is held engaged with the fuse body 22 by a safety pin 66 comprising a rod 68 which extends through an opening in the plastic cover, through an opening 24.1 in the base 24, FIG. 4, and through an opening 68.1 in the slider bar 34, FIG. 5, and an arm 70 which overlies the apex of the cover. The cover 64 cannot be removed without first removing the safety pin 66; hence, the slider bar cannot be displaced except by removal of the safety pin and the cover and also by unscrewing the firing pin 50. In addition to displacing the slider bar, a centrifugal force of sufficient magnitude to displace the yielding latch 42 from the inclined groove 48 is required. The cover 64 comprises a drogue and is attached by the drag ribbon 72 to the upper end of the firing pin 50. As shown, FIG. 2, the drag ribbon 72 comprises a loop 74 of flexible material threaded through openings 76—76 in the drogue and attached at its ends 78—78 to the upper end of the firing pin between the washers 62—62. There is a sufficient length of drag ribbon so that the drogue can be disengaged from the body of the fuse and removed to a considerable distance from the end thereof to become air borne.

Figure 9:
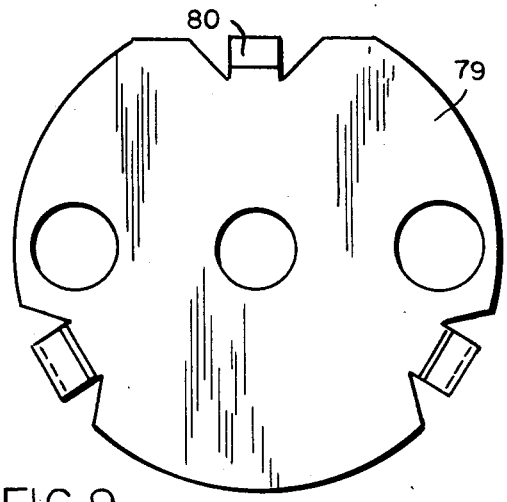
FIG. 9 is a plan view of the metal cover.

A metal cover plate 79, FIGS. 1 and 9, provided with latch means 80 is removably attached to the lower side of the part 24. The cover plate holds the slider bar 34 within the groove 28 while permitting the latter to move laterally into any position.

The fuse body 22 is mounted to the grenade 14 by placing it over the rivets 20—20 and expanding the ends of the rivets. Preparatory to mounting the assembly to the projectile, the safety pin 66 has been manually removed. At this point, the fuse is in a safety position since the slider bar 34 is held centered with respect to the striker 54 by the latch 42 and the firing pin 50 which is held engaged with the slider bar by reasons of the thread 55. No arming is required other than to remove the safety pin 66. A plurality of assemblies are mounted in tandem in the projectile, one above the other, and so the cover 64 of each fuse is held in place by the lower end of the previous grenade. Hence, the slider bar cannot be displaced even though all of the previous safeties have been released.

Figure 7:
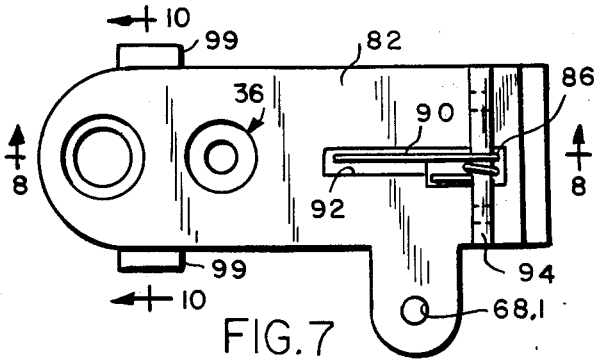
FIG. 7 is a plan view of an alternative form of slider bar.
Figure 8:
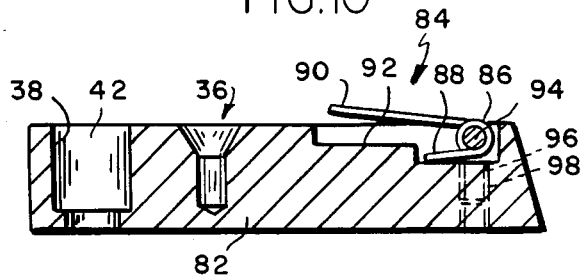
FIG. 8 is a section taken on the line 8—8 of FIG. 7.

An alternative form of slider bar 82 is shown in FIGS. 7 and 8 provided with a latch 84 in the form of a spring 86 having an anchoring arm 88 and a latch arm 90. The spring 86 is supported in an opening 92 in the slider bar 82 by a pintle pin 94 having at its opposite ends legs 96—96 engaged with openings 98—98 formed in the slider bar. The arm 90, by engagement with the housing, prevents lateral movement of the slider bar until a predetermined centrifugal force is developed.

In operation, when the projectile is fired and moves through its trajectory, it rotates about its longitudinal axis.

Above the target area, an electronic or mechanical time fuse fires an expelling charge and the pressure is transmitted through a plate and the column of the grenades to the base of the projectile and so the base of the projectile is detached form the body of the projectile. The assemblies comprising the grenades and attached fuses are expelled and dispersed above the target area and, due to their spin, the fuses become armed, as will now be described.

The drag ribbon 74 is unfolded as air pressure disengages the drogue from the fuse and due to the spin of the grenade, the drag ribbon 74 unscrews the firing pin 50 and releases the slider bar 34. The centrifugal force applies lateral pressure to the slider bar, and this pressure causes the latch 46 to yield due to the inclined groove 48 so this lateral movement of the slider bar brings the detonator 42 on line with the striker 54. The latch 46 holds the slider bar in its armed position. The striker 54 will be held in its retracted upper position due to the drogue and drag ribbon attached thereto. The slider bar 34 is held in the right position by engagement of the latch 46 with the notch 47 in the part 24 and by engagement of stops 99—99 with the ends of slots 97—97 so that any movement of the slider bar from the armed position is prevented.

When the grenade reaches the ground or any other object, the striker 54, due to the weight of the firing pin assembly 50, comes to a percussive engagement with the detonator 42 and the explosion of the detonator passes through the central hole of the metal plate 79 and causes the penetration of the lead cup 18 and so the booster explodes and this, in turn, fires the charge 16 of the grenade 12.

Desirably, the fuse body 22, the slider bar 34 and drogue 64 are made of plastic material, for example, polycarbonate. The drag ribbon 74 is made of nylon, or silk, or polyester, and it must be textiled in order to be folded easily.

The device as described provides for maximum safety in use to personnel involved, is relatively simple to arm, and foolproof in operation.

It should be understood that the present disclosure is for the purpose of illustration only and includes all modifications or improvements which fall within the scope of the appended claims.

What is claimed is:

1. A percussion-type fuse assembly comprising a generally cylindrical housing containing an axial opening and at one end a diametrical slot, a slider bar slidably supported in the slot, said slider bar containing a first opening in alignment with said opening in the housing and second opening radially thereof, a detonator in the second opening, a firing pin mounted in the housing with an end engaged with the first opening, said firing pin normally constraining diametrical movement of the slider bar, a weight disposed about the firing pin and movable relative thereto, said weight supporting the firing pin for retraction relative to said weight and from said first opening in the slider bar in response to rotation of the housing at a predetermined rate of rotation to release the slider bar, said weight being movable relative to the firing pin upon impact to impel the firing pin into engagement with the detonator, a cap in the form of a drogue mounted to the housing, a tether attaching the cap to the firing pin, said cap being displaceable rearwardly relative to the housing to constrain movement of the firing pin relative to the housing prior to impact, said tether being housed within the cap so long as the latter remains engaged with the housing and a keeper operable to hold the cap engaged with the housing, said keeper being manually removable to free the cap prior to use.

2. A fuse assembly according to claim 1 comprising a latch yieldably holding the slider bar against diametral movement, yieldable at a predetermined rate of rotation force to release the bar.

3. A fuse assembly according to claim 2 wherein the latch is operable to hold the slider bar when the slider bar has been moved to a position of alignment of the detonator with the firing pin to hold it in said position.

4. A fuse assembly according to claim 2 wherein the diametral slot has at an end stops and the slider bar has stops engageable therewith to limit the movement of the slider bar in the slot to a position in which the detonator is aligned with the firing pin.

5. A fuse assembly according to claim 4 wherein the latch holds the stops engaged.

6. A fuse assembly according to claim 2 wherein the housing contains an inclined slot facing the slider bar and wherein the latch is yieldably engaged with said inclined slot.

7. A fuse assembly according to claim 1 wherein the drogue is a generally conical cap positioned astride the opposite end of the housing and the tether is a flexible ribbon threaded to the drogue and attached at its ends to the firing pin.

8. A fuse assembly according to claim 1 wherein a safety pin is mounted to the housing provided with an end which overlies the drogue and retains the latter in engagement with said opposite end of the housing.

9. A fuse assembly according to claim 1 wherein the housing is provided with means for attachment thereof to a grenade.

10. A fuse assembly according to claim 1 wherein there is a metal cover plate removably attached to said one end of the body provided with means for engagement with the lower end of the body of the fuse so as to prevent the slider bar to fall off the fuse, but to permit the slider bar to slide into arming positions.

11. A fuse assembly according to claim 1 wherein the keeper is a safety pin mounted to the housing with a part extending across the cap and a part extending through the housing into the slider bar.

* * * * *